US011385563B2

(12) United States Patent
Ooka

(10) Patent No.: US 11,385,563 B2
(45) Date of Patent: Jul. 12, 2022

(54) DEVELOPING CARTRIDGE HAVING FIRST INCLINED SURFACE MOVABLE TOGETHER WITH FIRST SHAFT, AND SECOND INCLINED SURFACE MOVABLE TOGETHER WITH SECOND SHAFT

(71) Applicant: BROTHER KOGYO KABUSHIKI KAISHA, Nagoya (JP)

(72) Inventor: Kazuaki Ooka, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/374,273

(22) Filed: Jul. 13, 2021

(65) Prior Publication Data

US 2021/0341855 A1 Nov. 4, 2021

Related U.S. Application Data

(63) Continuation of application No. PCT/JP2020/005457, filed on Feb. 13, 2020.

(30) Foreign Application Priority Data

Mar. 28, 2019 (JP) ..... JP2019-063300

(51) Int. Cl.
*G03G 15/08* (2006.01)

(52) U.S. Cl.
CPC ..... *G03G 15/0808* (2013.01); *G03G 15/0865* (2013.01)

(58) Field of Classification Search
CPC ..... G03G 15/0808; G03G 15/0865
See application file for complete search history.

(56) References Cited

U.S. PATENT DOCUMENTS 6,647,228 B2 * 11/2003 Nakamura ..... G03G 15/0194 399/124
8,099,031 B2 * 1/2012 Kitagawa ..... G03G 15/0136 399/302

(Continued)

FOREIGN PATENT DOCUMENTS

JP 30-125865 A 7/1985
JP 2010-054828 A 3/2010

(Continued)

OTHER PUBLICATIONS

International Search Report and Written Opinion issued in PCT/JP2020/005457, dated Mar. 24, 2020.

*Primary Examiner* — Sevan A Aydin
(74) *Attorney, Agent, or Firm* — Merchant & Gould P.C.

(57) ABSTRACT

A developing cartridge includes: a developing roller rotatable about a first axis extending in a first direction; a casing; a first shaft extending in the first direction and movable in the first direction between a first position and a second position; a first inclined surface movable together with the first shaft; a second shaft extending in the first direction and movable in the first direction between a third position and a fourth position; a second inclined surface movable together with the second shaft; and a link mechanism connecting the first shaft to the second shaft. The link mechanism shifts to a first state to move the second shaft to the third position when the first shaft is at the first position. The link mechanism shifts to a second state to move the second shaft to the fourth position when the first shaft is at the second position.

32 Claims, 12 Drawing Sheets

(56) References Cited

U.S. PATENT DOCUMENTS

| | | | | |
|---|---|---|---|---|
| 2007/0196141 | A1* | 8/2007 | Kitagawa | G03G 15/1605 399/302 |
| 2008/0286001 | A1* | 11/2008 | Matsumoto | G03G 21/1828 399/112 |
| 2009/0220273 | A1* | 9/2009 | Tomatsu | G03G 21/1853 399/112 |
| 2011/0064457 | A1 | 3/2011 | Okabe et al. | |
| 2015/0147100 | A1* | 5/2015 | Okamoto | G03G 15/0189 399/302 |
| 2016/0252877 | A1 | 9/2016 | Nakamura et al. | |
| 2019/0094792 | A1* | 3/2019 | Kurihara | G03G 15/0813 |

FOREIGN PATENT DOCUMENTS

| | | | | |
|---|---|---|---|---|
| JP | 2011-059510 | A | | 3/2011 |
| KR | 20120055431 | A | * | 12/2012 |
| KR | 20120088039 | A | * | 12/2012 |
| WO | 2012/130295 | A1 | | 10/2012 |

* cited by examiner

DEVELOPING CARTRIDGE HAVING FIRST INCLINED SURFACE MOVABLE TOGETHER WITH FIRST SHAFT, AND SECOND INCLINED SURFACE MOVABLE TOGETHER WITH SECOND SHAFT

CROSS REFERENCE TO RELATED APPLICATION

This is a by-pass continuation application of International Application No. PCT/JP2020/005457 filed on Feb. 13, 2020 which claims priority from Japanese Patent Application No. 2019-063300 filed Mar. 28, 2019. The entire contents of the earlier applications are incorporated herein by reference.

TECHNICAL FIELD

The present disclosure relates to a developing cartridge.

BACKGROUND

Conventionally, there have been known electro-photographic type image-forming apparatuses such as laser printers and LED printers. Such a conventional image-forming apparatus includes a developing cartridge. The developing cartridge includes a developing roller for supplying developing agent. One of such conventional image-forming apparatuses is disclosed in a prior art. The image-forming apparatus described therein includes a drum cartridge including a photosensitive drum. The developing cartridge is attachable to the drum cartridge. Upon attachment of the developing cartridge to the drum cartridge, the photosensitive drum and the developing roller contact with each other.

SUMMARY

The image-forming apparatus according to the above prior art is switchable between a state where the developing roller and the photosensitive drum are in contact with each other and a state where the developing roller and the photosensitive drum are in separation from each other. In the image-forming apparatus according to the above prior art, components for moving the developing cartridge to separate the developing roller from the photosensitive drum are provided at each side of a drum unit. The components at each side must receive a driving force from a main body of the image-forming apparatus.

In view of the foregoing, it is an object of the present disclosure to provide a developing cartridge capable of providing separation between the developing roller and photosensitive drum by a driving force transmitted from only one side without necessitating application of driving force to both sides.

In order to attain the above and other objects, according to one aspect, the present disclosure provides a developing cartridge including a casing, a developing roller, a first shaft, a first inclined surface, a second shaft, a second inclined surface, and a link mechanism. The casing is configured to accommodate developing agent therein. The developing roller is rotatable about a first axis extending in a first direction. The casing has one end portion and another end portion in the first direction. The casing also has one end portion in a second direction crossing the first direction and the developing roller is positioned at the one end portion of the casing in the second direction. The developing roller has a peripheral surface a portion of which is exposed to an outside of the casing in the second direction. The first shaft extends in the first direction and is movable relative to the casing and the developing roller in the first direction between a first position and a second position. The first shaft is also movable in the second direction together with the casing and the developing roller. The first inclined surface is inclined with respect to the first direction and is movable in the first direction together with the first shaft. The first inclined surface is inclined to be distant from the first shaft in the second direction as extending from the another end portion of the casing in the first direction toward the one end portion of the casing in the first direction. The second shaft extends in the first direction and is positioned closer to the another end portion of the casing in the first direction than the first shaft is to the another end portion of the casing in the first direction. The second shaft is movable relative to the casing and the developing roller in the first direction between a third position and a fourth position. The second shaft is also movable in the second direction together with the casing and the developing roller. The second inclined surface is inclined with respect to the first direction and is movable in the first direction together with the second shaft. The second inclined surface is inclined to be distant from the second shaft in the second direction as extending from the another end portion of the casing in the first direction toward the one end portion of the casing in the first direction. The link mechanism connects the first shaft to the second shaft. The link mechanism is configured to shift between a first state and a second state. The link mechanism is shifted to the first state to render the second shaft to be at the third position in a case where the first shaft is at the first position. The link mechanism is shifted to the second state to render the second shaft to be at the fourth position in a case where the first shaft is at the second position.

According to another aspect, the present disclosure also provides a developing cartridge including a casing, a developing roller, a first shaft, a first cam, a second shaft, a second cam, and a link mechanism. The casing is configured to accommodate therein developing agent. The developing roller is rotatable about a first axis extending in a first direction. The casing has one end portion and another end portion in the first direction. The first shaft extends along a second axis extending in the first direction and the first shaft is movable along the second axis. The first cam is movable together with the first shaft along the second axis. The first cam has a first inclined surface inclined with respect to the first direction. The second shaft extends along a third axis extending in the first direction and the second shaft is movable along the third axis. The second cam is movable together with the second shaft along the third axis. The second cam has a second inclined surface inclined with respect to the first direction. The link mechanism connects the first shaft to the second shaft. The second shaft and the second cam are movable along the third axis in accordance with shifting of the link mechanism from the first state to the second state.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, one embodiment of the disclosure will be described with reference to accompanying drawings.

In the following description, a direction in which a rotational axis (first axis) of a developing roller extends will be called as a "first direction." On a peripheral surface of the developing roller, a portion exposed to outside of a casing and a portion accommodated within the casing will be assumed to be arranged side by side in a "second direction." Here, the first direction and the second direction cross each other, preferably orthogonal to each other. Further, a direction crossing both the first and second directions (preferably, orthogonal to the first and second directions) will be called as a "third direction."

1. Overall Configuration of Image-Forming Apparatus

Figure 1:
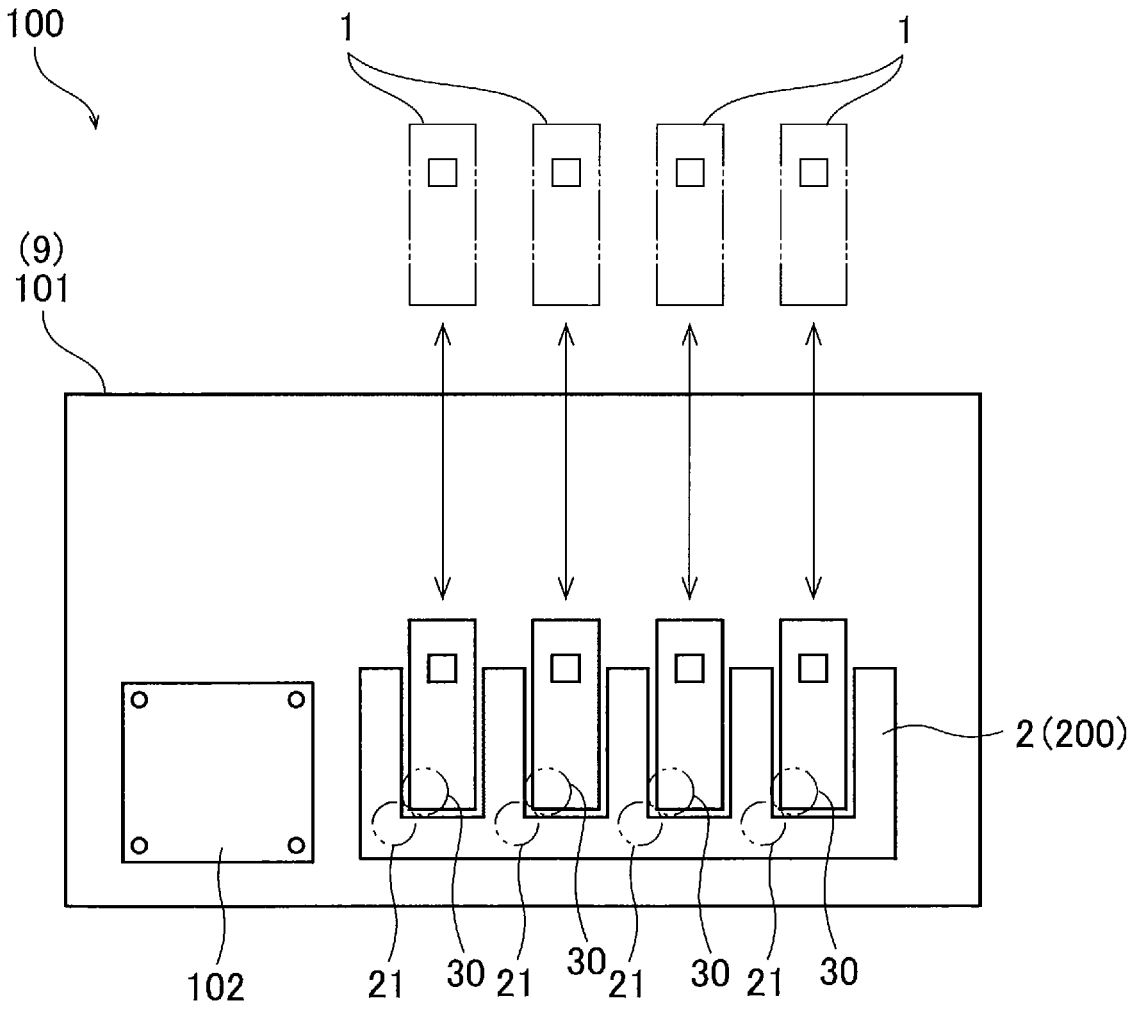
FIG. 1 is a schematic diagram of an image-forming apparatus.

FIG. 1 is a schematic diagram of an image-forming apparatus 100. The image-forming apparatus 100 is an electrophotographic-type printer, such as a laser printer and an LED printer. As illustrated in FIG. 1, the image-forming apparatus 100 includes four developing cartridges 1 according to the present embodiment, a drum cartridge 2, and a main body portion 9.

1-1. Overall Configuration of Main Body Portion

Hereinafter, an overall configuration of the main body portion 9 will be described. As illustrated in FIG. 1, the main body portion 9 includes a main-body frame 101, a transfer belt (not illustrated), and a controller 102.

The main-body frame 101 is a generally rectangular parallelepiped and has an internal space therein. The drum cartridge 2 with the developing cartridges 1 attached thereto can be accommodated in the internal space of the main-body frame 101. Further, in the main-body frame 101, four chargers (not illustrated), four light sources (not illustrated), the transfer belt, and the controller 102 are provided.

The main-body frame 101 is a generally rectangular parallelepiped and defines an internal space therein. The drum cartridge 2 with the developing cartridges 1 attached thereto is configured to be accommodated in the internal space of the main-body frame 101. In the main-body frame 101, four chargers (not illustrated), four light sources (not illustrated), the transfer belt, and the controller 102 are also positioned.

The transfer belt is an endless belt for conveying printing sheets. In a state where the drum cartridge 2 to which the developing cartridges 1 are attached is positioned in the internal space of the main-body frame 101, the transfer belt is positioned opposite to developing rollers 30 with respect to photosensitive drums 21. The transfer belt has an outer peripheral surface contactable with outer peripheral surfaces of the respective photosensitive drums 21.

The controller 102 includes a processor such as a CPU, and a main-body memory. The main-body memory is a readable and writable storage medium, such as a Flash ROM and EEPROM. The main-body memory is configured to store computer programs for controlling operations performed in the image-forming apparatus 100. The processor is configured to execute various processing according to the computer programs stored in the main-body memory. That is, the processor is configured to execute various printing processing and other processing associated therewith to be performed in the image-forming apparatus 100.

1-2. Overall Configurations of Developing Cartridges

Figure 2:
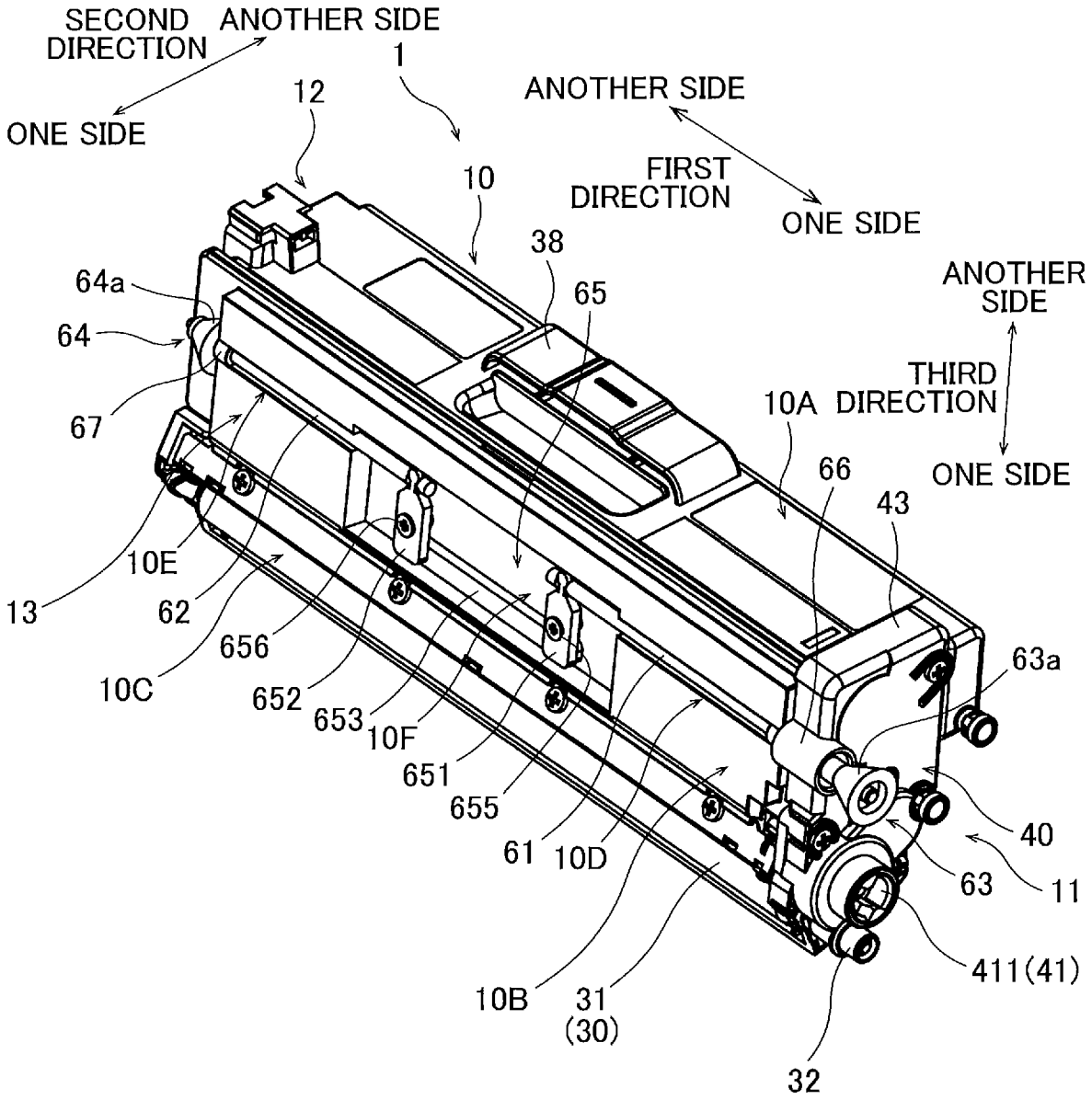
FIG. 2 is a perspective view of a developing cartridge according to one embodiment.

An overall structure of each developing cartridge 1 will be described next with reference to FIGS. 1 and 2. FIG. 2 is a perspective view of the developing cartridge 1 according to the embodiment.

As illustrated in FIG. 1, the developing cartridges 1 are attachable to and detachable from a frame 200 of the drum cartridge 2. As illustrated in FIG. 2, each developing cartridge 1 includes a casing 10 configured to store therein developing agent. The casing 10 includes a container portion 10A, and a lid portion 10B. The container portion 10A defines an internal space therein. The lid portion 10B is flat plate shaped. The lid portion 10B is positioned at one end portion of the casing 10 in the second direction. The lid portion 10B has a third outer surface 13 (outer surface) described later. The lid portion 10B covers an opening portion positioned at one end portion of the container portion 10A in the second direction. The container portion 10A has one end portion in the third direction where an opening 10C is formed. A developing roller 30 (described later) is positioned at the opening 10C.

The casing 10 has one end portion in the first direction which has a first outer surface 11. The casing 10 has another end portion in the first direction which has a second outer surface 12. The casing 10 also has the third outer surface 13 and a fourth outer surface 14 (FIG. 9) spaced away from each other in the second direction. The third outer surface 13 is positioned at one end portion of the casing 10 in the second direction. The fourth outer surface 14 is positioned at another end portion of the casing 10 in the second direction. The third outer surface 13 extends in a direction crossing the second direction.

The four developing cartridges 1 accommodate therein toner of different colors (for example, cyan, magenta, yellow and black), respectively. However, the four developing cartridges 1 may accommodate therein toner of an identical color.

Each developing cartridge 1 includes one developing roller 30. The developing roller 30 is cylindrical in shape. The developing roller 30 is rotatable about a rotational axis (first axis) extending in the first direction. The developing roller 30 is supported by the casing 10 so as to be rotatable about the first axis.

The developing roller 30 includes a developing-roller body 31 and a developing-roller shaft 32. The developing-roller body 31 is hollow cylindrical in shape and extends in the first direction. The developing-roller body 31 is made from an elastic material, such as rubber. The developing-roller shaft 32 is a solid cylindrical member penetrating through the developing-roller body 31 in the first direction. The developing-roller shaft 32 is made from meal or electrically conductive resin. The developing-roller body 31 is fixed to the developing-roller shaft 32 without relative rotation therebetween. That is, the developing-roller body 31 is rotatable together with the developing-roller shaft 32 about the developing-roller axis. A part of an outer peripheral surface of the developing-roller body 31 in the second direction is exposed to the outside of the casing 10 through the opening 10C. A remaining part in the second direction of the outer peripheral surface of the developing-roller body 31 is positioned inside the casing 10.

The developing-roller shaft 32 has one end portion in the first direction. A developing-roller gear (not illustrated) is attached to the one end portion of the developing-roller shaft 32 in the first direction. The developing-roller gear is positioned at the first outer surface 11. The developing-roller gear is fixed to the one end portion of the developing-roller shaft 32 without relative rotation therebetween. Hence, a rotation of the developing-roller gear causes a rotation of the developing-roller shaft 32, so that the developing-roller body 31 is rotatable together with the developing-roller shaft 32.

Incidentally, the developing-roller shaft 32 may not extend through the developing-roller body 31 in the first direction. For example, the developing-roller shaft 32 may be configured of two shafts extending outward in the first direction respectively from both ends of the developing-roller body 31 in the first direction.

As illustrated in FIG. 2, each developing cartridge 1 also includes a gear portion 40. The gear portion 40 is positioned at the first outer surface 11 of the casing 10. The gear portion 40 includes the developing-roller gear described above, a coupling 41, and a gear cover 43.

The coupling 41 is a rotary member configured to receive a driving force supplied from a power source in the image-forming apparatus 100. The coupling 41 is rotatable about a rotational axis extending in the first direction. The coupling 41 has a fixing hole 411 recessed inward in the first direction. Upon attachment of the drum cartridge 2 to the main body portion 9 with the developing cartridges 1 attached to the drum cartridge 2, a transmission shaft (not shown) of the main body portion 9 is configured to be inserted in the fixing hole 411. The transmission shaft and the coupling 41 are thus connected each other without relative rotation therebetween. Accordingly, rotation of the transmission shaft causes rotation of the coupling 41. In accordance with the rotation of the coupling 41, the developing-roller gear rotates together with the developing roller 30. The rotation of the coupling 41 also causes rotations of a supply roller (not illustrated) and an agitator (not illustrated).

A handle 38 for being gripped by a user is positioned at an outer surface of another end portion of the casing 10 at the other side in the third direction.

1-3. Overall Configuration of Drum Cartridge

Figure 3:
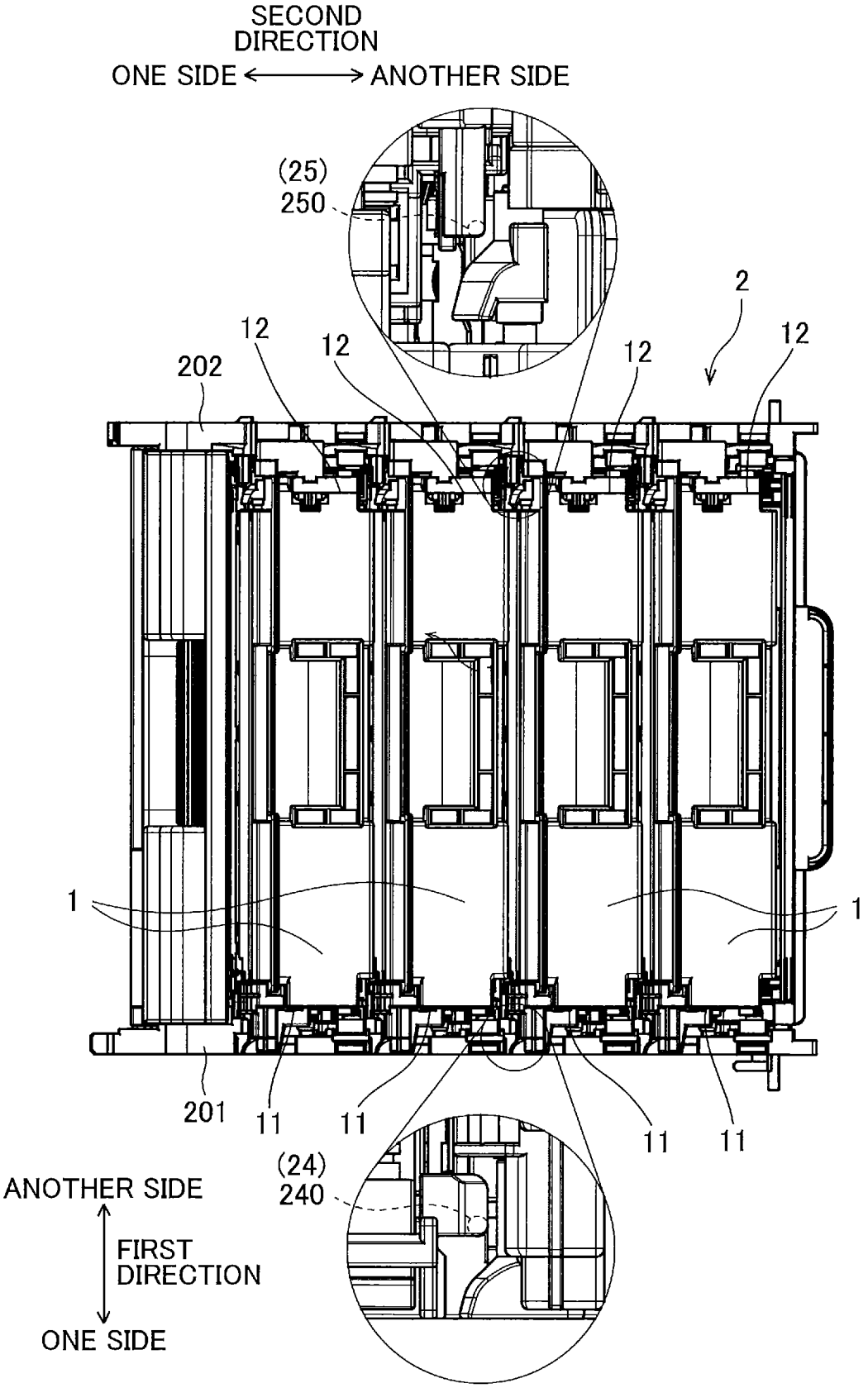
FIG. 3 is a view of a drum cartridge to which the developing cartridge according to the embodiment is attached as viewed from another side thereof in a third direction.

Next, an overall configuration of the drum cartridge 2 will be described next with reference to FIGS. 1 and 3. FIG. 3 is a plan view of the drum cartridge 2 according to the embodiment. As illustrated in FIGS. 1 and 3, the drum cartridge 2 includes four of the photosensitive drums 21, and the frame 200.

Each of the four photosensitive drums 21 has a cylindrical-shaped outer peripheral surface centered on a drum axis, which is a rotational axis extending in the first direction. The outer peripheral surface is a surface coated with photosensitive material. Each of the four photosensitive drums 21 is rotatable about the drum axis.

The frame 200 illustrated in FIG. 3 is a frame supporting the four photosensitive drums 21. The frame 200 holds the four photosensitive drums 21 such that the photosensitive drums 21 are spaced away from one another in the second direction. The frame 200 includes a pair of side frames (drum frames) 201, 202 opposite each other in the first direction. The side frame 202 is positioned further in the first direction toward the other side than the side frame 201. The photosensitive drums 21 are rotatably supported by the side frames 201 and 202.

For performing a printing process in the image-forming apparatus 100, the controller 102 drives a motor (not illustrated) so that the photosensitive drums 21 and the developing rollers 30 can rotate by a driving force transmitted from the motor through the transmission shaft and the coupling 41. Further, the controller 102 supplies power to the chargers (not illustrated) to charge the outer peripheral surfaces of the respective photosensitive drums 21. The controller 102 further causes the light sources (not illustrated) to emit light onto the outer peripheral surfaces of the respective photosensitive drums 21. In this way, an electrostatic latent image corresponding to a printing image is formed on the outer peripheral surface of each photosensitive drum 21. The toner accommodated in each developing cartridge 1 is then supplied through the corresponding developing roller 30 to the electrostatic latent image formed on the corresponding photosensitive drum 21. Thus, the electrostatic latent image becomes a visible toner image on the outer peripheral surface of each photosensitive drum 21.

Then, a printing sheet is conveyed between each photosensitive drum 21 and the transfer belt, whereby the toner image is transferred from the outer peripheral surface of each photosensitive drum 21 onto the printing sheet. The printing sheet carrying the toner image is then conveyed to a fixing unit (not illustrated) where the toner image is thermally fixed to the printing sheet. Image printing on the printing sheet is performed in this way.

In the image-forming apparatus 100, it may be preferable that the developing rollers 30 be separated from the corresponding photosensitive drums 21, for example, in order to change colors for printing or during a standby period. For this purpose, the image-forming apparatus 100 of the present embodiment provides a contacting state and a separated state. The contacting state denotes a state where the developing rollers 30 and the photosensitive drums 21 are in contact with each other in a state where the developing cartridges 1 are attached to the drum cartridge 2. The separated state denotes a state where the developing rollers 30 and the photosensitive drums 21 are separated from each other in the state where the developing cartridges 1 are attached to the drum cartridge 2.

Figure 6:
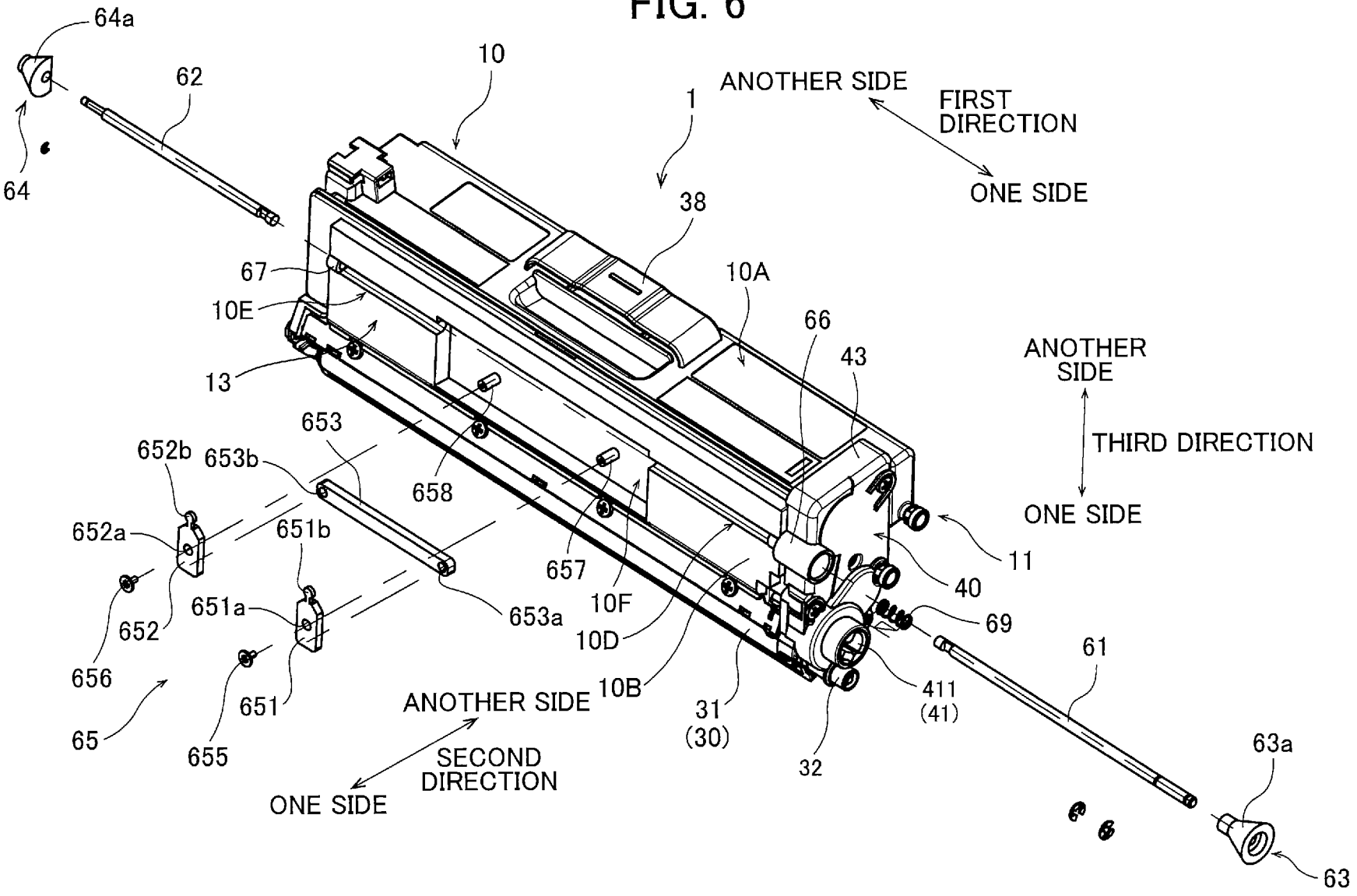
FIG. 6 is an exploded perspective view of the developing cartridge according to the embodiment.

To this effect, as components for realizing the contact and the separation, each developing cartridge 1 includes a first shaft 61, a second shaft 62, a first cam 63, a second cam 64, a link mechanism 65, a first ring 66, a second ring 67, and a resilient member 69 (see FIG. 6). Further, as components for realizing the contact and the separation, the drum cartridge 2 includes a first guide roller (pressure contact portion) 24, and a second guide roller (pressure contact portion) 25. As components for realizing the contact and the separation, the main body portion 9 includes four drive shafts 103.

2. Components in Drum Cartridge for Contact and Separation

Hereinafter, components of the drum cartridge 2 for performing the contact and the separation between the developing rollers 30 and the photosensitive drums 21 will be described with reference to FIGS. 3 through 5.

As illustrated in FIG. 3, in the state where the developing cartridges 1 are attached to the drum cartridge 2, the first outer surface 11 of each developing cartridge 1 faces an inner surface of the first side frame 201 in the first direction. Also, in the state where the developing cartridges 1 are attached to the drum cartridge 2, the second outer surface 12 of each developing cartridge 1 faces an inner surface of the second side frame 202 in the first direction.

As indicated by a broken line in a partially enlarged view in FIG. 3, the first side frame 201 includes the first guide roller 24. That is, the first guide roller 24 is positioned at one end portion of the frame 200 in the first direction.

Figure 4:
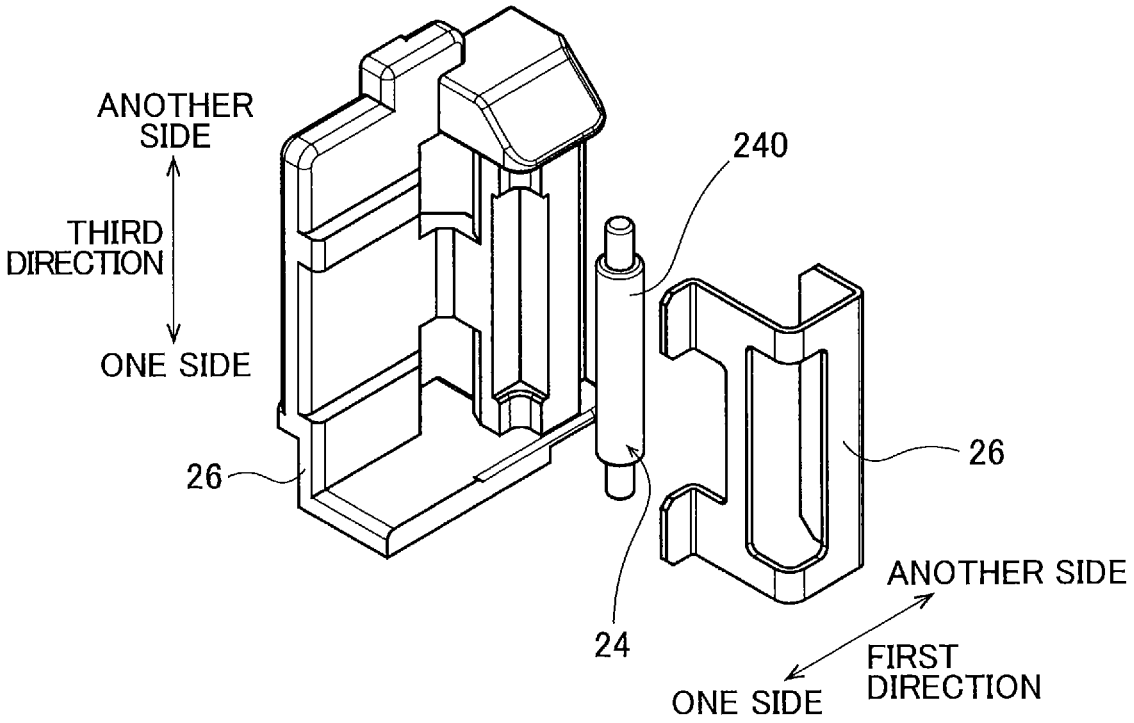
FIG. 4 is a perspective view of a first guide roller supported by a bearing portion of the drum cartridge.

FIG. 4 is an exploded perspective view of the first guide roller 24 and a bearing portion 26 holding the first guide roller 24. As illustrated in FIG. 4, the first guide roller 24 has an outer peripheral surface (pressure contact surface) 240 of a cylindrical shape extending in the third direction. The first guide roller 24 has end portions in the third direction each rotatably supported by the bearing portion 26. Thus, the first guide roller 24 is rotatable about a center axis thereof extending in the third direction.

As indicated by a broken line in another partially enlarged view in FIG. 3, the second side frame 202 includes the second guide roller 25. That is, the second guide roller 25 is positioned at another end portion of the frame 200 in the first direction.

Figure 5:
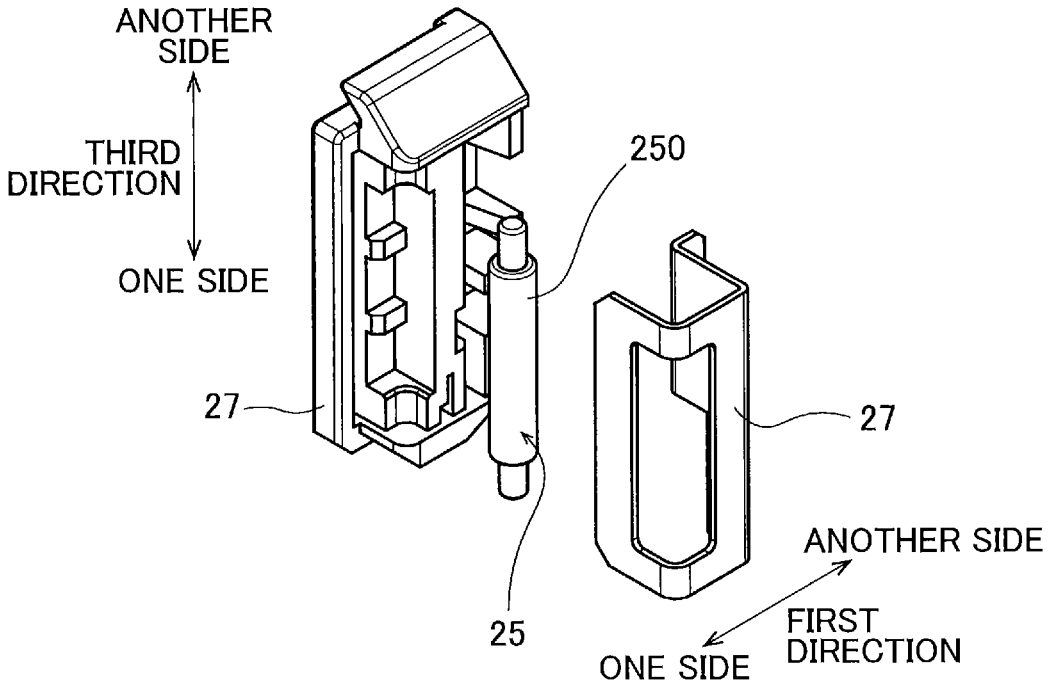
FIG. 5 is a perspective view of a second guide roller supported by a bearing portion of the drum cartridge.

FIG. 5 is an exploded perspective view of the second sleeve 25 and a bearing portion 27 holding the second guide roller 25. The second guide roller 25 has a cylindrical-shaped outer peripheral surface (pressure contact surface) 250 extending in the third direction. The second guide roller 25 has end portions in the third direction each rotatably supported by the bearing portion 27. Thus, the second guide roller 25 is rotatable about a center axis thereof extending in the third direction.

The first guide roller 24 and the second guide roller 25 are positioned to be aligned with each other in the first direction as a pair. As will be described later, a first inclined surface 63*a* of the first cam 63 is contactable with the outer peripheral surface 240 of the first guide roller 240, and a second inclined surface 64*a* of the second cam 64 is contactable with the outer peripheral surface 250 of the second guide roller 25.

3. Components in Main Body Portion for Contact and Separation

Next, a component of the main body portion 9 for realizing the contact and separation between the developing rollers 30 and the photosensitive drums 21 will be described.

The main body portion 9 includes the drive shafts 103 (see FIGS. 8 and 10) as components for performing the contact and the separation. Each drive shaft 103 is a solid cylinder or solid prismatic column extending in the first direction. The drive shaft 103 is movable in the first direction between an advanced position and a retracted position upon receiving a driving force from a power source of the main body portion 9.

4. Components in Developing Cartridge for Contact and Separation

Figure 7:
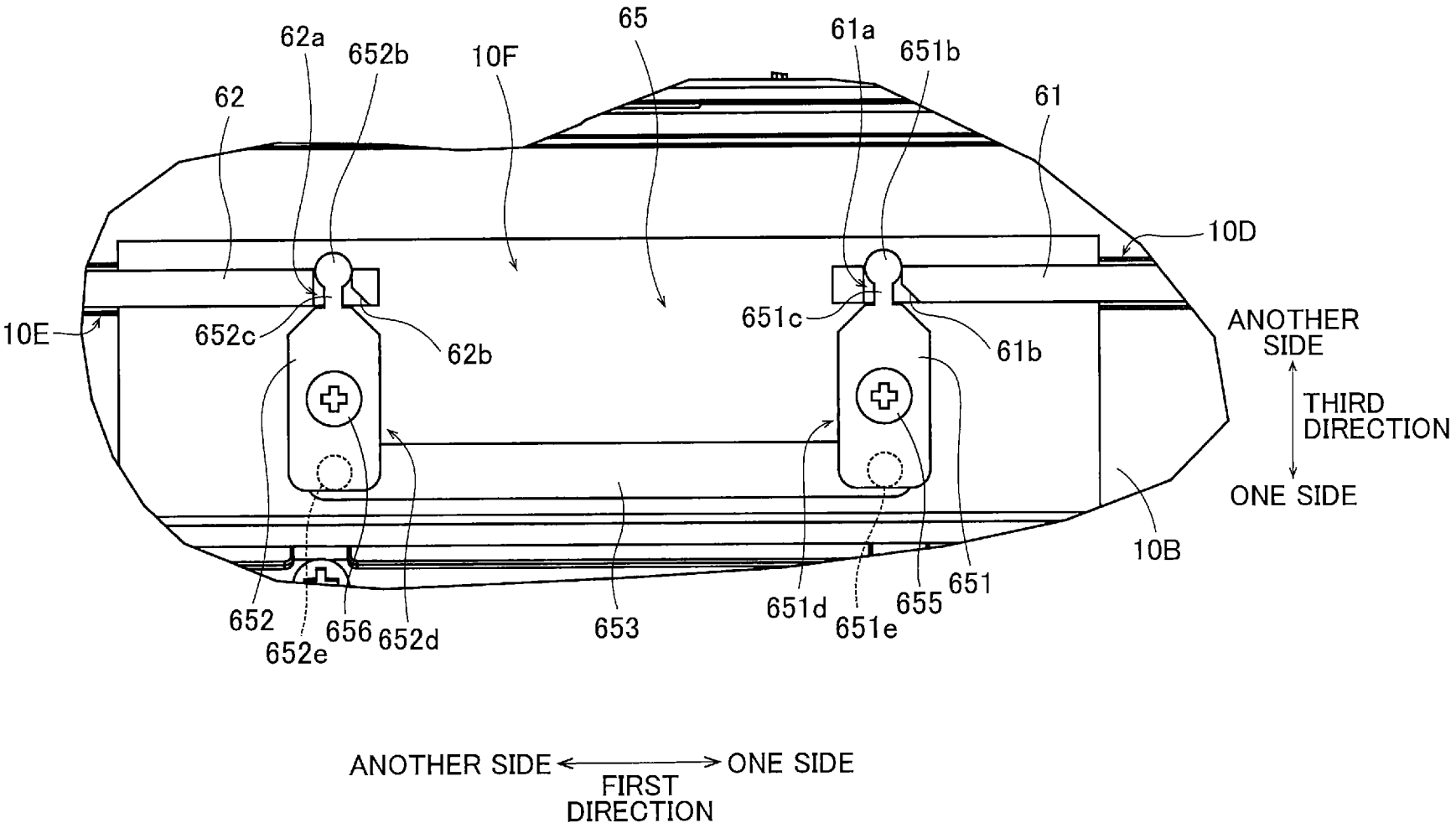
FIG. 7 is an enlarged view illustrating a link mechanism in the developing cartridge according to the embodiment in a contacting state.

Next, components of the developing cartridge 1 for realizing the contact and the separation between the developing rollers 30 and the photosensitive drums 21 will be described with reference to FIGS. 2, 6 and 7. FIG. 6 is an exploded perspective view of the developing cartridge 1 according to the embodiment. FIG. 7 is an enlarged view of the link mechanism 65 in the contacting state.

The first shaft 61 has a solid cylindrical shape or solid prismatic columnar shape extending in the first direction. The first shaft 61 is held at the third outer surface 13 of the casing 10 so as to be movable in the first direction, relative to the casing 10 and the developing roller 30, between a first position and a second position (described later). The first shaft 61 is held at the third outer surface 13 so as to be movable in the second direction together with the casing 10 and the developing roller 30.

Specifically, the lid portion 10B has a first guide groove 10D at the third outer surface 13. The first guide groove 10D extends along a second axis extending in the first direction. The first guide groove 10D has one end portion at the one side in the first direction. The first ring 66 is positioned at the one end portion of the first guide groove 10D in the first direction. The first ring 66 is hollow cylindrical and extends in the first direction. The first ring 66 of the embodiment is held by the gear cover 43. Alternatively, the first ring 66 may be integral with the gear cover 43. The first ring 66 is positioned between the first cam 63 and the link mechanism 65 in the first direction. The first shaft 61 is inserted in the first ring 66 and is slidably held by the first guide groove 10D. The first shaft 61 is thus positioned along the second axis. The first shaft 61 is movable in the first direction along the second axis.

The second shaft 62 has a solid cylindrical shape or solid prismatic columnar shape extending in the first direction. The first shaft 61 is held at the third outer surface 13 of the casing 10 so as to be movable in the first direction, relative to the casing 10 and the developing roller 30, between a third position and a fourth position described later. The second shaft 62 is held at the third outer surface 13 so as to be movable in the second direction together with the casing 10 and the developing roller 30.

Specifically, the lid portion 10B also has a second guide groove 10E at the third outer surface 13. The second guide groove 10E extends along a third axis extending in the first direction. The second guide groove 10E is positioned further in the first direction toward the other side than the first guide groove 10D. The second guide groove 10E has another end portion at the other side in the first direction. The second ring 67 is positioned at the other end portion of the second guide groove 10E in the first direction. The second ring 67 is hollow cylindrical and extends in the first direction. The second ring 67 is held by the other end portion of the second guide groove 10E in the first direction. The second ring 67 is positioned between the second cam 64 and the link mechanism 65 in the first direction. The second shaft 62 is inserted in the second ring 67 and is slidably held by the second guide groove 10E. Hence, the second shaft 62 is positioned along the third axis at a position closer to the other end portion in the first direction of the casing 10 than the first shaft 61 is to the other end portion in the first direction of the casing 10. The second shaft 62 is movable in the first direction along the third axis.

The first cam 63 is connected to one end portion of the first shaft 61 in the first direction. The first cam 63 is positioned further in the first direction toward the one side (outward) than the first ring 66. The first cam 63 is movable in the first direction together with the first shaft 61 along the second axis. The first cam 63 of the present embodiment is conical in shape. The first cam 63 has an outer peripheral surface including the first inclined surface 63*a*. The first inclined surface 63*a* is inclined with respect to the first direction with an acute angle. The first inclined surface 63*a* is movable together with the first shaft 61 in the first direction. The first inclined surface 63*a* is sloped to be distant from the first shaft 61 in the second direction as extending in the first direction from the other side toward the one side.

The second cam 64 is connected to another end portion of the second shaft 62 at the other side in the first direction. The second cam 64 is positioned further in the first direction toward the other side (outward) than the second ring 67. The second cam 64 is movable together with the second shaft 62 in the first direction along the third axis. The second cam 64 of the present embodiment is semi-conical in shape. The second cam 64 has an outer peripheral surface including the second inclined surface 64*a*. The second inclined surface 64*a* is sloped with respect to the first direction with an acute angle. The second inclined surface 64*a* is movable together with the second shaft 62 in the first direction. The second inclined surface 64*a* is inclined to be distant from the second shaft 62 in the second direction as extending in the first direction from the other side toward the one side.

The link mechanism 65 connects the first shaft 61 to the second shaft 62. The link mechanism 65 includes a first link 651, a second link 652, a connection bar 653, a first screw 655, and a second screw 656. The link mechanism 65 is switchable between a first state and a second state.

FIGS. 2 and 6 to 8 illustrate the first state of the link mechanism 65. In the first state, the first link 651 extends in the third direction. The first link 651 has a plate-like shape crossing the second direction. The first link 651 includes a plate portion 651*d*, a protruding portion 651*b*, and a narrow portion 651*c*. The protruding portion 651*b* is another end portion of the first link 651 at the other side in the third direction. The protruding portion 651*b* is circular in shape as viewed in the second direction. The narrow portion 651*c* is positioned further in the third direction toward the one side than the protruding portion 651*b*. That is, the narrow portion 651*c* is positioned between the protruding portion 651*b* and the plate portion 651*d* in the third direction in the first state. The narrow portion 651*c* has a width in the first direction smaller than respective widths of the protruding portion 651*b* and the plate portion 651*d*.

As illustrated in FIG. 7, the first shaft 61 has another end portion in the first direction at the other side. The other end portion of the first shaft 61 has a first guide recess 61*a*. The first guide recess 61*a* is recessed in the second direction toward the other side from the one side. The first guide recess 61*a* extends in the third direction to penetrate, in the third direction, the other end portion of the first shaft 61 in the first direction. The first guide recess 61*a* has a first inner wall surface at the other side in the first direction. The first inner wall surface is a flat plane extending perpendicular to the first direction. The first guide recess 61*a* also has a second inner wall surface at the one side in the first direction. The second inner wall surface has a first guide sloped surface 61*b* sloping to be distant from the first inner wall surface in the first direction as extending in the third direction toward the one side from the other side.

The first guide recess 61*a* has an open end portion at the other side in the third direction. The protruding portion 651*b* of the first link 651 is engaged with the open end portion of the first guide recess 61*a*. Hence, the other end portion of the first link 651 in the third direction is connected to the other end portion of the first shaft 61 in the first direction. The first link 651 includes a third boss 651*e* positioned at one end portion of the plate portion 651*d* in the third direction (see FIG. 7). The third boss 651*e* is solid cylindrical in shape and protrudes in the second direction toward the other side. The first link 651 has a third through-hole 651*a* (FIG. 6) positioned between both end portions of the first link 651 in the third direction in the first state of the link mechanism 65.

As illustrated in FIGS. 2 and 6 to 8, in the first state, the second link 652 extends in the third direction. The second link 652 has a plate-like shape crossing the second direction. The first link 651 includes a protruding portion 652*b*, a plate portion 652*d*, and a narrow portion 652*c*. The protruding portion 652*b* is another end portion of the second link 652 at the other side in the third direction. The protruding portion 652*b* is circular in shape as viewed in the second direction. The narrow portion 652*c* is positioned further in the third direction toward the one side than the protruding portion 652*b*. That is, the narrow portion 652*c* is positioned between the protruding portion 652*b* and the plate portion 652*d* in the third direction in the first state. The narrow portion 652*c* has a width in the first direction smaller than respective widths of the protruding portion 652*b* and the plate portion 652*d*.

As illustrated in FIG. 7, the second shaft 62 has one end portion at the one side in the first direction. The one end portion of the shaft 62 in the first direction has a second guide recess 62*a*. The second guide recess 62*a* is recessed in the second direction toward the other side. The second guide recess 62*a* extends in the third direction to penetrate, in the third direction, the one end portion of the second shaft 62 in the first direction. The second guide recess 62*a* has a first inner wall surface at the other side in the first direction. The first inner wall surface is a flat plane extending perpendicular to the first direction. The second guide recess 62*a* also has a second inner wall surface at the other side in the first direction. The second inner wall surface has a second guide sloped surface 62*b* sloping to be distant from the first inner wall surface in the first direction as extending in the third direction toward the one side from the other side.

The second guide recess 62*a* has an open end portion at the other side in the third direction. The protruding portion 652*b* of the second link 652 is engaged with the open end portion of the second guide recess 62*a*. Hence, the other end portion of the second link 652 in the third direction is connected to the one end portion of the second shaft 62 in the first direction. The second link 652 includes a fourth boss 652*e* positioned at one end portion of the plate portion 652*d* in the third direction (see FIG. 7). The fourth boss 652*e* is solid cylindrical in shape and protrudes in the second direction toward the other side. The second link 652 has a fourth through-hole 652*a* (FIG. 6) positioned between the one end portions and the other end portions of the second link 652 in the third direction in the first state of the link mechanism 65.

As illustrated in FIGS. 2 and 6, the connection bar 653 extends in the first direction. The connection bar 653 is flat-plate shaped, and extends in a direction crossing the second direction. The connection bar 653 has one end portion in the first direction having a first through-hole 653*a*. The first through-hole 653*a* extends through a thickness of the connection bar 653 in the second direction. The connection bar 653 has another end portion in the first direction having a second through-hole 653*b*. The second through-hole 653*b* extends through the thickness of the connection bar 653 in the second direction.

The third boss 651*e* of the first link 651 is inserted in the first through-hole 653*a* of the connection bar 653. The fourth boss 652*e* of the second link 652 is inserted in the second through-hole 653*b* of the connection bar 653. In this way, the connection bar 653 is connected to the one end portion in the third direction of the first link 651 and to the one end portion in the third direction of the second link 652.

The lid portion 10B has an intermediate portion in the first direction. The intermediate portion has a recessed portion 10F recessed in the second direction toward the other side. Inside the recessed portion 10F, the other end portion in the first direction of the first shaft 61, the one end portion in the first direction of the second shaft 62, the first link 651, the second link 652, and the connection bar 653 are positioned.

The recessed portion 10F has a bottom surface from which a first boss 657 protrudes in the second direction toward the one side. The first boss 657 is hollow cylindrical in shape. The first boss 657 has an inner peripheral surface formed with a female thread. Further, a second boss 658 protrudes from the bottom surface of the recessed portion 10F in the second direction toward the one side. The second boss 658 is hollow cylindrical in shape. The second boss 658 has an inner peripheral surface formed with a female thread. The second boss 658 is positioned away from the first boss 657 in the first direction. The second boss 658 is positioned further in the first direction toward the other side than the first boss 657.

The first screw 655 extends in the second direction. The first screw 655 has a head portion at the one side, and a shaft portion at the other side in the second direction. The shaft portion has an outer peripheral surface formed with a male thread. The first screw 655 pivotally movably supports the first link 651 relative to the casing 10.

Specifically, the third boss 651*e* of the first link 651 is inserted in the first through-hole 653*a* of the connection bar 653, and the protruding portion 651*b* of the first link 651 is engaged with the open end portion of the first guide recess 61*a*. In this state, the shaft portion of the first screw 655 is threadingly engaged with the first boss 657. Hence, the first link 651 is pivotally movable about the first screw 655. That is, the first link 651 is pivotally movable about a first pivot axis extending in the second direction.

The second screw 656 extends in the second direction. The second screw 656 has a head portion at the one side, and a shaft portion at the other side in the second direction. The shaft portion has an outer peripheral surface formed with a male thread. The second screw 656 pivotally movably supports the second link 652 relative to the casing 10.

Specifically, the fourth boss 652*e* of the second link 652 is inserted in the second through-hole 653*b* of the connection bar 653, and the protruding portion 652*b* of the second link 652 is engaged with the open end portion of the second guide recess 62*a*. In this state, the shaft portion of the second screw 656 is threadingly engaged with the second boss 658. Hence, the second link 652 is pivotally movable about the second screw 656. That is, the second link 652 is pivotally movable about a second pivot axis extending in the second direction.

As illustrated in FIG. 6, the resilient member 69 is a coil spring which is a metal wire helically wound. The resilient member 69 is expandable and shrinkable in the first direction. The resilient member 69 is held inside the first ring 66 such that: one end in the first direction of the resilient member 69 is connected to an inner peripheral surface of the first ring 66; and another end of the resilient member 69 in the first direction is connected to an outer peripheral surface of the first shaft 61. The resilient member 69 is compressed in the first direction to have a length smaller than a natural length of the resilient member 69. With this structure, the resilient member 69 urges the first shaft 61 in the first direction toward the one side. In other words, the resilient member 69 urges the first shaft 61 in a direction from the second position toward the first position.

5. Movement of Each Component at the Time of Switching Between Contact and Separation Hereinafter, how each component operates for realizing switching between the contact and the separation will be described with reference to FIGS. 7 through 13.

Figure 8:
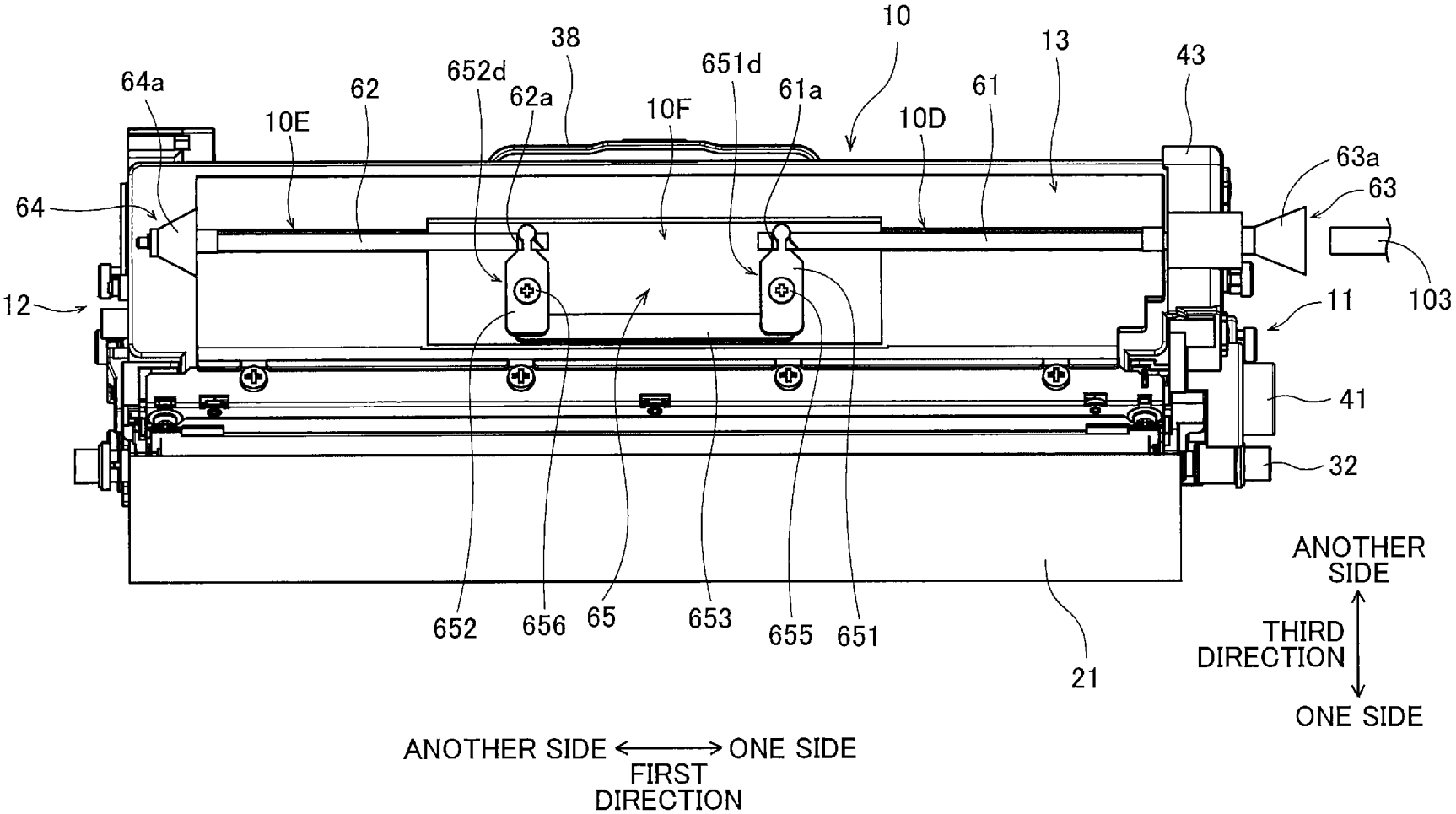
FIG. 8 is a view of the developing cartridge and a photosensitive drum in the contacting state as viewed from one side thereof in a second direction.
Figure 9:
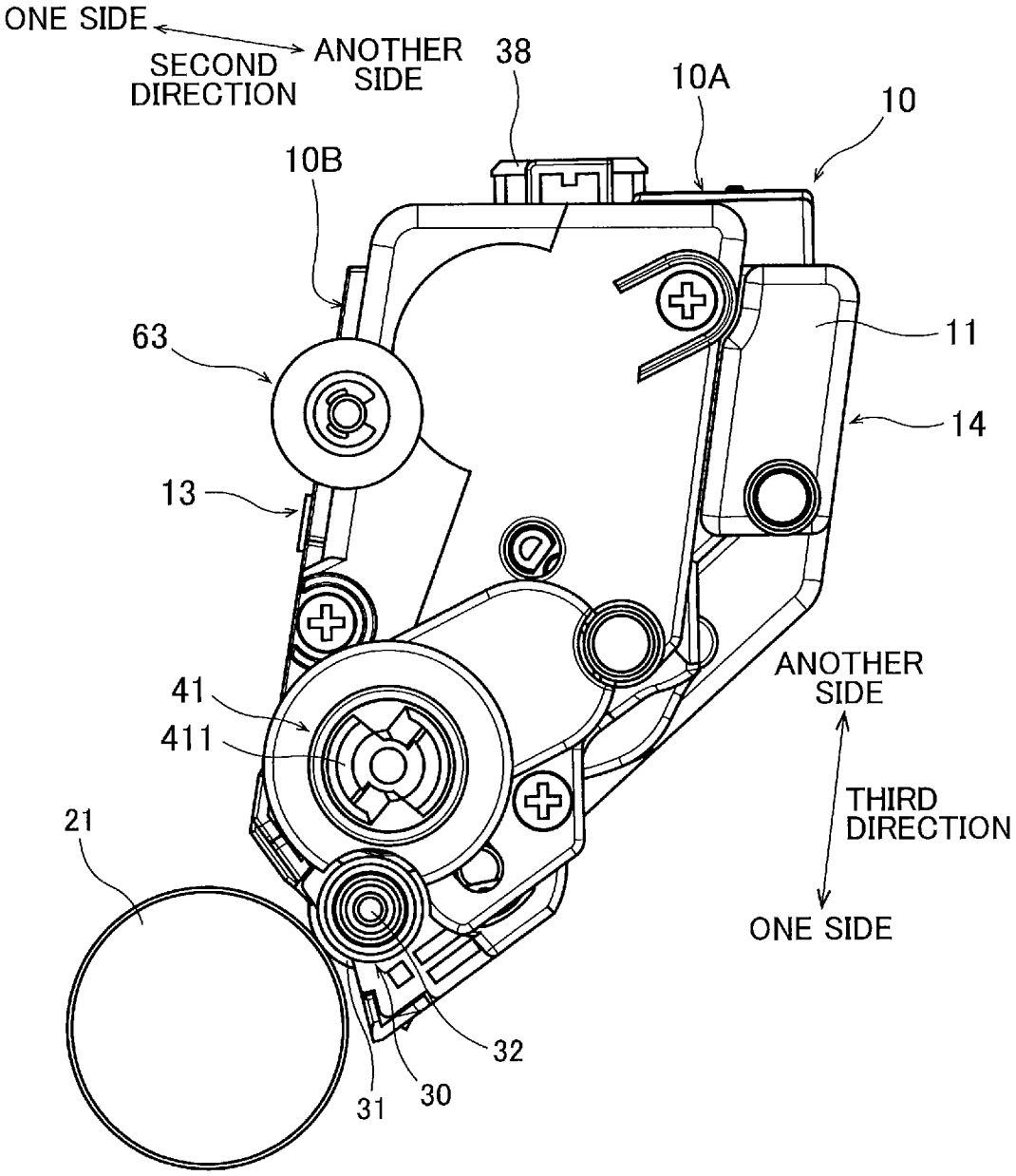
FIG. 9 is a view of the developing cartridge and the photosensitive drum in the contacting state as viewed from one side thereof in a first direction.
Figure 10:
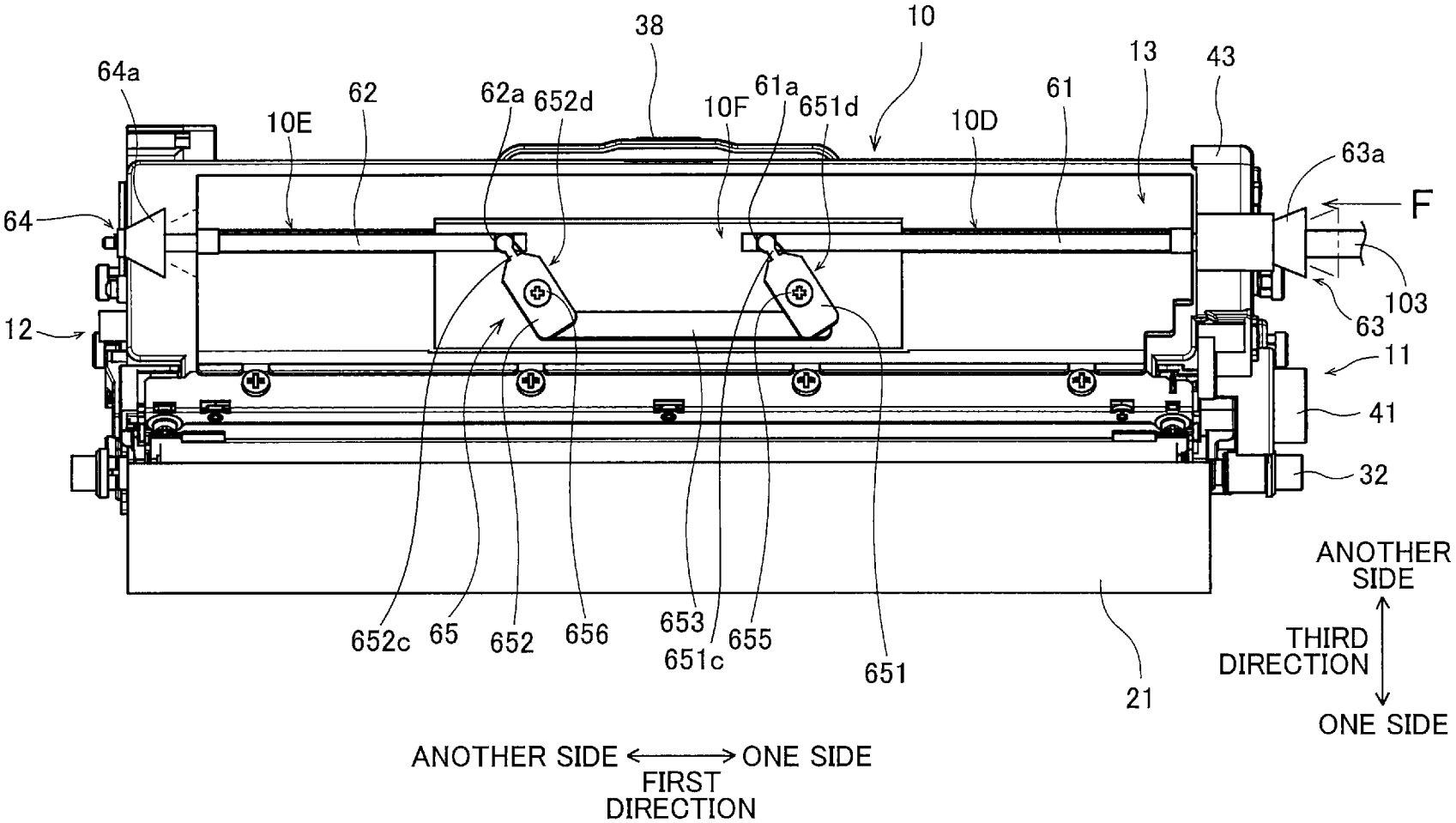
FIG. 10 is a view of the developing cartridge and the photosensitive drum in a separated state as viewed from one side thereof in the second direction.
Figure 11:
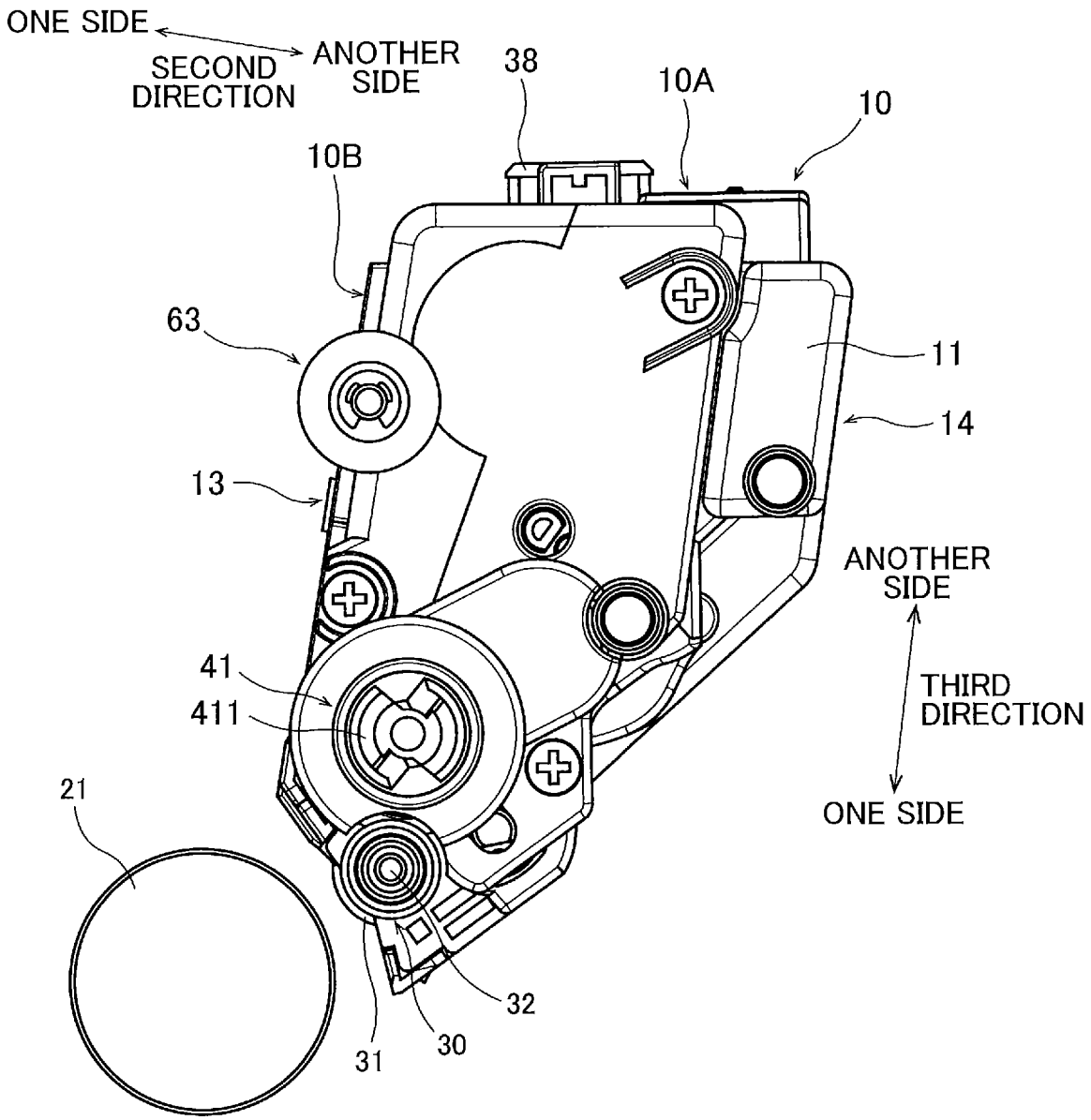
FIG. 11 is a view of the developing cartridge and the photosensitive drum in the separated state as viewed from one side thereof in the first direction.
Figure 12:
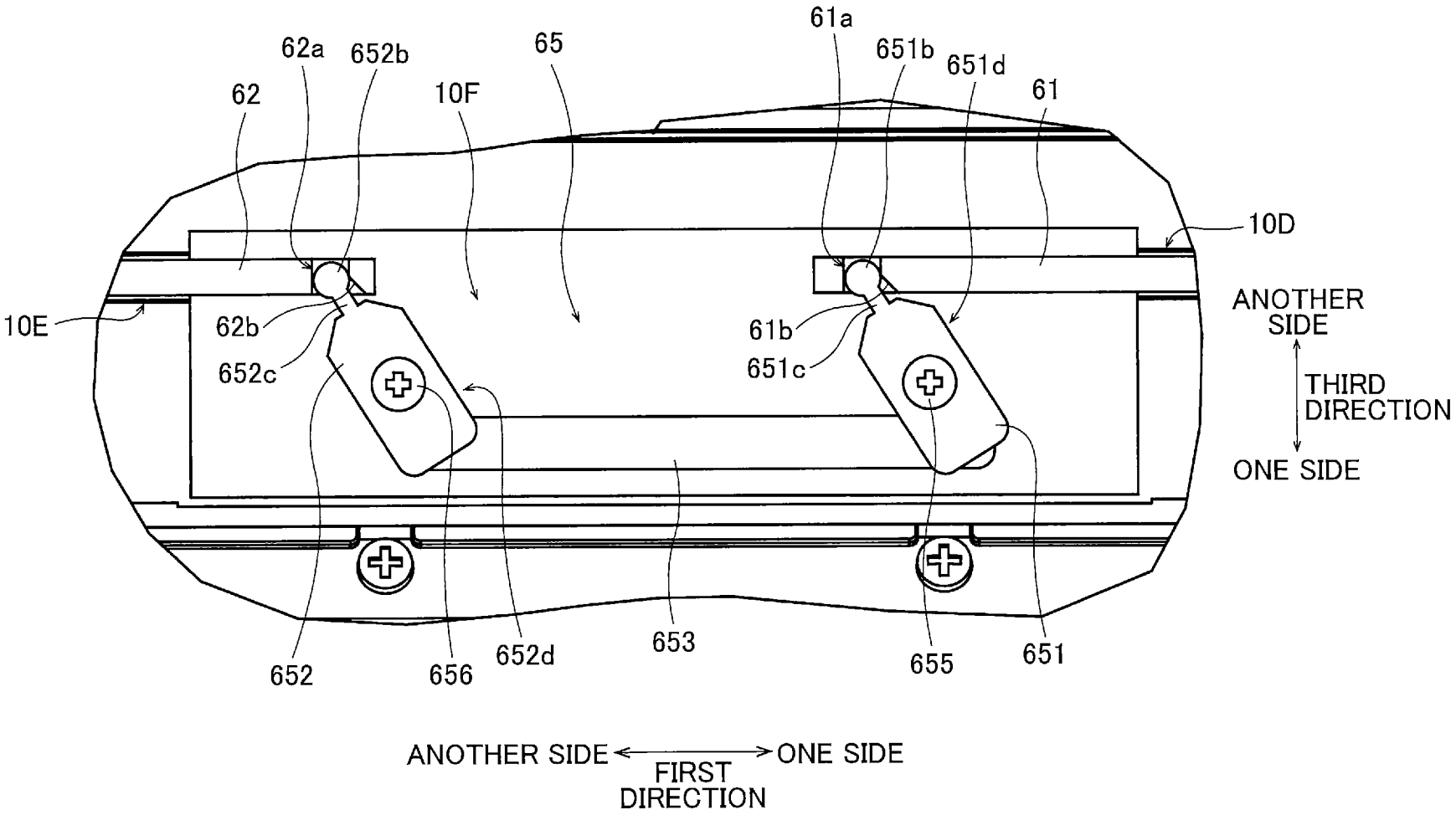
FIG. 12 is an enlarged view illustrating the link mechanism in the developing cartridge according to the embodiment in the separated state.
Figure 13:
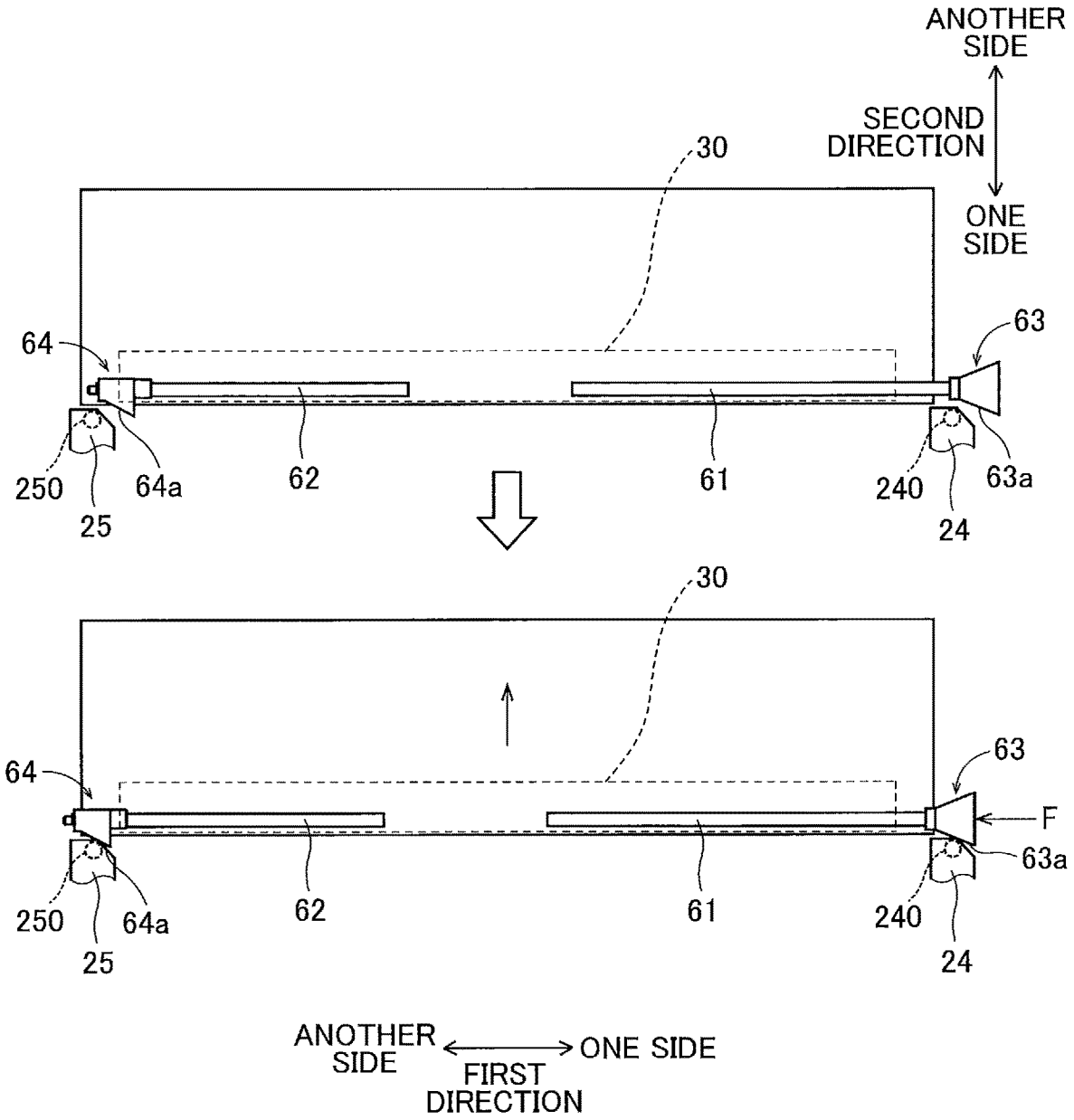
FIG. 13 is a conceptual diagram illustrating switching from the contacting state to the separated state.

FIG. 8 is a view of the developing cartridge 1 and the photosensitive drum 21 in the contacting state as viewed from the one side thereof in the second direction. FIG. 9 is a view of the developing cartridge 1 and the photosensitive drum 21 in the contacting state as viewed from one side thereof in the first direction. FIG. 10 is a view of the developing cartridge 1 and the photosensitive drum 21 in the separated state as viewed from one side thereof in the second direction. FIG. 11 is a view of the developing cartridge 1 and the photosensitive drum 21 in the separated state as viewed from one side thereof in the first direction. FIG. 12 is an enlarged view illustrating the link mechanism 65 in the separated state. FIG. 13 is a conceptual diagram illustrating switching from the contacting state to the separated state.

In the image-forming apparatus 100, in a case where the drive shaft 103 is driven or moved toward the advanced position toward the other side in the first direction, one end surface of the corresponding first cam 63 facing toward the one side in the first direction is pressed by the drive shaft 103. That is, the first cam 63 receives a pressing force F directing from the one end portion toward the other end portion in the first direction of the casing 10.

The pressing force F applied to the first cam 63 is greater than an urging force of the resilient member 69 applied to the first shaft 61 and the first cam 63. Hence, the first shaft 61 is moved together with the first cam 63 from the first position (FIG. 8) to the second position (FIG. 10). Accordingly, the first guide recess 61*a* is also moved in the direction from the one end portion toward the other end portion in the first direction of the casing 10. The first link 651 is thus caused to pivotally move counterclockwise about the first pivot axis as viewed from the one side thereof in the second direction.

At this time, the narrow portion 651*c* of the first link 651 is tilted along the first guide sloped surface 61*b*, as illustrated in FIG. 12. Accordingly, the connection bar 653 is pulled by the one end portion in the third direction of the first link 651, so that the connection bar 653 is moved in a direction from the other end portion to the one end portion in the first direction of the casing 10.

In accordance with the movement of the connection bar 653, the one end portion in the third direction of the second link 652 is pulled by the connection bar 653, thereby causing the second link 652 to pivot about the second pivot axis. Specifically, the second link 652 pivotally moves counter-clockwise about the second pivot axis as viewed from the one side thereof in the second direction. Pivotal movement of the second link 652 is performed generally in parallel with pivotal movement of the first link 651. At this time, the narrow portion 652*c* of the second link 652 is tilted along the second guide sloped surface 62*b*. As a result, the protruding portion 652*b* pushes the second guide recess 62*a*, so that the second shaft 62 is moved in the direction from the one end portion to the other end portion in the first direction of the casing 10. Thus, the second shaft 62 is moved together with the second cam 64 from the third position (FIG. 8) to the fourth position (FIG. 10).

In this way, upon application of the pressing force F in the first direction from the drive shaft 103 to the first cam 63, the first shaft 61 is moved from the first position to the second position, so that the link mechanism 65 is switched from the first state (illustrated in FIGS. 7 and 8) to the second state (illustrated in FIGS. 10 and 12). Consequently, the second shaft 62 is moved from the third position to the fourth position.

In the meantime, the first inclined surface 63*a* of the first cam 63 is in contact with the outer peripheral surface 240 of the first guide roller 24 of the first side frame 201. Here, a contacting position of the first inclined surface 63*a* with the first guide roller 24 is gradually shifted from a position near the other end toward a position near the one end in the first direction of the first inclined surface 63*a* (see FIG. 13). As a result, a distance between the drum cartridge 2 (the outer peripheral surface 240) and the casing 10 in the second direction is gradually increased. Hence, as illustrated in FIG. 13, since the first sloped surface 63*a* is pressed by the outer peripheral surface 240 of the first guide roller 24 of the drum cartridge 2, the casing 10 and the developing roller 30 are caused to move together with the first cam 63 in the second direction to separate the developing roller 30 from the corresponding photosensitive drum 21.

In response to the movement of the first cam 63 from the first position to the second position, the second cam 64 also moves from the third position to the fourth position. Accordingly, as illustrated in FIG. 13, since the second sloped surface 64*a* is also pressed by the outer peripheral surface 250 of the second guide roller 25 of the drum cartridge 2, the casing 10 and the developing roller 30 are caused to move together with the second cam 64 in the second direction.

In this way, both end portions of the casing 10 in the first direction are respectively pressed by the first guide roller 24 and the second guide roller 25 which are parts of the drum cartridge 2, so that the casing 10 is moved from the one side toward the other side in the second direction relative to the drum cartridge 2. With this structure, inclination of the casing 10 with respect to the first direction can be restrained at the time of switching between the contacting state (FIGS. 8 and 9) and the separated state (FIGS. 10 and 11).

In a case where the drive shaft 103 is moved to its retracted position, that is, moved in the direction from the other end portion to the one end portion in the first direction of the casing 10, the first shaft 61 is moved relative to the casing 10 in the first direction from the other end portion toward the one end portion of the casing 10 by the urging force of the resilient member 69. Hence, the first shaft 61 is moved together with the first cam 63 from the second position (FIG. 10) to the first position (FIG. 8). In accordance with this movement of the first shaft 61, the first guide recess 61*a* is also moved in the first direction from the other end portion to the one end portion of the casing 10.

As a result, the first link 651 is pivotally moved about the first pivot axis in a clockwise direction as viewed in the second direction from the one side toward the other side. At this time, the narrow portion 651*c* of the first link 651 extends along the first inner wall surface of the first guide recess 61*a* (see FIG. 7). In other words, since the movement of the narrow portion 651*c* of the first link 651 is restrained by the first inner wall surface of the first guide recess 61*a*, further pivotal movement of the first link 651 in the clockwise direction is restrained. Accordingly, the first link 651 is maintained in a posture extending in the third direction, as illustrated in FIG. 7.

In accordance with the pivotal movement of the first link 651 in the clockwise direction, the connection bar 653 is pushed by the one end portion in the third direction of the first link 651, so that the connection bar 653 is cause to move in the first direction from the one end portion toward the other end portion of the casing 10.

Further, the one end portion in the third direction of the second link 652 is pushed by the connection bar 653, which causes pivotal movement of the second link 652. Specifically, the second link 652 is caused to pivotally move about the second pivot axis in the clockwise direction as viewed from the one side thereof in the second direction. The pivotal movement of the second link 652 is performed generally in parallel with the pivotal movement of the first link 651.

At this time, the narrow portion 652*c* of the second link 652 extends along the first inner wall surface of the second guide recess 62*a* (see FIG. 7). In other words, since the movement of the narrow portion 652*c* of the second link 652 is restrained by the first inner wall surface of the second guide recess 62*a*, further pivotal movement of the second link 652 in the clockwise direction is restrained. Accordingly, as illustrated in FIG. 7, the second link 652 is maintained in the posture extending in the third direction.

The protruding portion 652*b* of the second link 652 pulls the second shaft 62 by the pivotal movement of the second link 652, so that the second shaft 62 is moved in the first direction from the other end portion toward the one end portion of the casing 10. Hence, the second shaft 62 is moved from the fourth position (FIG. 10) to the third position (FIG. 8) together with the second cam 64.

In a state where the pressing force F from the drive shaft 103 is no longer applied to the corresponding first cam 63, the first shaft 61 is moved from the second position to the first position, the link mechanism 65 is shifted from the second state to the first state, and accordingly, the second shaft 62 is caused to move from the fourth position to the third position.

Here, the frame 200 of the drum cartridge 2 includes a pressure mechanism (not illustrated) for pressing the casing 10 of each developing cartridge 1 toward the corresponding photosensitive drum 21. By this pressure mechanism, the developing cartridge 1 is then pressed in the second direction toward the one side, so that the contacting state between the developing roller 30 and the photosensitive drum 21 is restored. As such, the state of the image-forming apparatus 100 is switchable between the contacting state (FIGS. 7 and 8) and the separated state (FIGS. 8 and 10).

Strictly speaking, the first inclined surface 63*a* is not in contact with the side frame 201 and the second inclined surface 64*a* is not in contact with the side frame 202 in a case where the first shaft 61 is at the first position and the second shaft 62 is at the third position. That is, the first inclined surface 63*a* and the second sloped surface 64*a* are brought into contact with the side frames 201 and 202, respectively, when the first shaft 61 starts moving from the first position toward the second position and the second shaft 62 starts moving from the third position toward the fourth position. Further, the first inclined surface 63*a* and the second inclined surface 64*a* are kept in contact with the side frames 201 and 202, respectively, when the first shaft 61 is positioned at the second position and the second shaft 62 is positioned at the fourth position. In this state, the developing roller 30 is in separation from the corresponding photosensitive drum 21.

6. Summary

The developing cartridge 1 according to the embodiment includes the casing 10, the developing roller 30, the first shaft 61, the first inclined surface 63*a*, the second shaft 62, the second inclined surface 64*a*, and the link mechanism 65. The link mechanism 65 is in the first state (FIG. 7) and the second shaft 62 is at the third position (FIG. 8), when the first shaft 61 is at the first position. The link mechanism 65 is in the second state (FIG. 12) and the second shaft 62 is at the fourth position when the first shaft 61 is at the second position (FIG. 10).

With this structure, the first inclined surface 63*a* and the second inclined surface 64*a* are pressed by the first guide roller 24 of the first side frame 201 and the second guide roller 25 of the second side frame 202, respectively, during the movement of the first shaft 61 from the first position toward the second position and the movement of the second shaft 62 from the third position toward the fourth position. Hence, the developing roller 30 is moved in the second direction toward the other side.

As such, in the developing cartridge 1 according to the embodiment, separation of the developing roller 30 from the photosensitive drum 21 can be performed by the driving force applied only to the one side in the first direction of the developing cartridge 1. Application of driving force to both sides in the first direction of the developing cartridge 1 is unnecessary.

Further, the link mechanism 65 of the developing cartridge 1 according to the embodiment includes the first link 651, the second link 652, and the connection bar 653. With this structure, enhanced mechanical strength of each component can be obtained in comparison with a conceivable structure where the first inclined surface 63*a* and the second inclined surface 64*a* are connected together directly by a single shaft.

Further, in the developing cartridge 1 according to the embodiment, the third outer surface 13 of the casing 10 has the recessed portion 10F in which the first link 651, the second link 652, and the connection bar 653 are positioned. This structure can reduce a likelihood that light emitted from a light source provided in the main body portion 9 toward the photosensitive drum 21 is blocked by the link mechanism 65.

Further, the developing cartridge 1 according to the embodiment includes the resilient member 69. The first shaft 61 can be returned to the first position and the second shaft 62 can be returned to the third position by the urging force of the resilient member 69 after the first shaft 61 has moved from the first position to the second position and the second shaft 62 has moved from the third position to the fourth position.

Further, the developing cartridge 1 according to the embodiment includes the casing 10, the developing roller 30, the first shaft 61, the first cam 63, the second shaft 62, the second cam 64, and the link mechanism 65. The link mechanism 65 is shifted from the first state to the second state in accordance with the movement of the first shaft 61 along the second axis. The second shaft 62 and the second cam 64 are moved along the third axis in accordance with shifting of the link mechanism 65 from the first state to the second state. Hence, the first inclined surface 63*a* of the first cam 63 and the second inclined surface 64*a* of the second cam 64 are pressed by the first guide roller 24 of the first side frame 201 and the second guide roller 25 of the second side frame 202, respectively, during the movement of the first shaft 61 along the second axis and the movement of the second shaft 62 along the third axis. As a result, the developing roller 30 can be moved in the direction crossing the first direction.

7. Modifications

While the disclosure has been described in detail with reference to the above embodiment, it would be apparent to those skilled in the art that many modifications and variations may be made therein without departing from the scope of the disclosure.

For example, in the above-described embodiment, the resilient member 69 for urging the first shaft 61 from the second position to the first position is provided. Instead or in addition to the resilient member 69, a resilient member for urging the second shaft 62 from the fourth position to the third position may be provided.

In the above-described embodiment, the resilient member 69 for urging the first shaft 61 from the second position to the first position is provided. Instead or in addition to the resilient member 69, a resilient member for urging the link mechanism 65 from the second state to the first state may be provided. Specifically, a torsion spring may be used as the resilient member. The torsion spring has one end portion connected to the first link 651, and another end portion connected to the casing 10.

Further, in the above-described embodiment, the recessed portion 10F for accommodating the first link 651, the second link 652, and the connection bar 653 is positioned at the intermediate portion of the casing 10 in the first direction. As a modification, a corresponding recessed portion may be positioned closer to the one end portion in the first direction of the casing 10, or closer to the other end portion in the first direction of the casing 10.

In the above-described embodiment, the inner wall surface of the first guide recess 61*a* of the first shaft 61 serves to restrict a pivotally movable range of the first link 651, and the inner wall surface of the second guide recess 62*a* of the second shaft 62 serves to restrict a pivotally movable range of the second link 652. Alternatively, a regulation plate(s) contactable with the first link 651 and/or second link 652 may be positioned within the recessed portion 10F so that the first link 651 and/or the second link 652 can contact the regulation plate(s) in order to regulate the pivotally movable ranges of the first link 651 and the second link 652.

Note that the detailed configuration of the developing cartridge 1 may be different from that described above and illustrated in the drawings. Further, each component in the above-described embodiment and modifications may be suitably combined together as long as no technical conflicts is incurred.

What is claimed is:

1. A developing cartridge comprising:

a casing configured to accommodate developing agent therein;

a developing roller rotatable about a first axis extending in a first direction, the casing having one end portion and another end portion in the first direction, the casing also having one end portion in a second direction crossing the first direction, the developing roller being positioned at the one end portion of the casing in the second direction, and the developing roller having a peripheral surface a portion of which is exposed to an outside of the casing in the second direction;

a first shaft extending in the first direction and movable relative to the casing and the developing roller in the first direction between a first position and a second position, the first shaft being also movable in the second direction together with the casing and the developing roller;

a first inclined surface inclined with respect to the first direction and movable in the first direction together with the first shaft, the first inclined surface being inclined to be distant from the first shaft in the second direction as extending from the another end portion of the casing in the first direction toward the one end portion of the casing in the first direction;

a second shaft extending in the first direction and positioned closer to the another end portion of the casing in the first direction than the first shaft is to the another end portion of the casing in the first direction, the second shaft being movable relative to the casing and the developing roller in the first direction between a third position and a fourth position, the second shaft being also movable in the second direction together with the casing and the developing roller;

a second inclined surface inclined with respect to the first direction and movable in the first direction together with the second shaft, the second inclined surface being inclined to be distant from the second shaft in the second direction as extending from the another end portion of the casing in the first direction toward the one end portion of the casing in the first direction; and a link mechanism connecting the first shaft to the second shaft, the link mechanism being configured to shift between a first state and a second state, wherein the link mechanism is shifted to the first state to render the second shaft to be at the third position in a case where the first shaft is at the first position, and wherein the link mechanism is shifted to the second state to render the second shaft to be at the fourth position in a case where the first shaft is at the second position.

2. The developing cartridge according to claim 1, wherein the first shaft has one end portion and another end portion in the first direction, the one end portion of the first shaft being closer to the one end portion of the casing in the first direction than the another end portion of the first shaft is to the one end portion of the casing in the first direction, and wherein the first inclined surface is positioned at the one end portion of the first shaft in the first direction.

3. The developing cartridge according to claim 1, wherein the second shaft has one end portion and another end portion in the first direction, the another end portion of the second shaft being closer to the another end portion of the casing in the first direction than the one end portion of the second shaft is to the another end portion of the casing in the first direction, and wherein the second inclined surface is positioned at the another end portion of the second shaft.

4. The developing cartridge according to claim 3, wherein the link mechanism comprises:

a first link having one end portion connected to the another end portion of the first shaft;

a second link having one end portion connected to the one end portion of the second shaft; and a connection bar connected to another end portion of the first link and to another end portion of the second link.

5. The developing cartridge according to claim 4, wherein the first link is pivotally movable about a first pivot axis extending in the second direction, and wherein the second link is pivotally movable about a second pivot axis extending in the second direction.

6. The developing cartridge according to claim 5, wherein, in accordance with movement of the first shaft from the first position to the second position, the first link pivotally moves about the first pivot axis to move the connection bar in the first direction to cause pivot movement of the second link about the second pivot axis, to thus move the second shaft from the third position to the fourth position.

7. The developing cartridge according to claim 5, wherein the first direction is perpendicular to the second direction.

8. The developing cartridge according to claim 5, further comprising:

a first screw extending in the second direction and supporting the first link to the casing; and a second screw extending in the second direction and supporting the second link to the casing.

9. The developing cartridge according to claim 8, wherein the first link is pivotally movable about the first screw, and wherein the second link is pivotally movable about the second screw.

10. The developing cartridge according to claim 5, wherein the casing comprises:

a first boss extending in the second direction; and a second boss extending in the second direction and positioned away from the first boss in the first direction, wherein the first link is pivotally movable about the first boss defining the first pivot axis, and wherein the second link is pivotally movable about the second boss defining the second pivot axis.

11. The developing cartridge according to claim 5, wherein the casing has an outer surface extending in a direction crossing the second direction, and wherein the first link, the second link, and the connection bar are positioned at the outer surface.

12. The developing cartridge according claim 11, wherein the outer surface has a recessed portion recessed in the second direction, and wherein the first link, the second link, and the connection bar are positioned in the recessed portion.

13. The developing cartridge according to claim 1, further comprising an urging member urging the first shaft toward the first position from the second position in the first direction.

14. The developing cartridge according to claim 1, further comprising an urging member urging the second shaft toward the third position from the fourth position in the first direction.

15. The developing cartridge according to claim 1, further comprising an urging member urging the link mechanism toward the first state from the second state.

16. The developing cartridge according to claim 13, wherein the urging member is a spring.

17. The developing cartridge according claim 16, wherein the spring is a coil spring.

18. The developing cartridge according to claim 1, wherein the first inclined surface is inclined with respect to the first direction with an acute angle, and the second inclined surface is inclined with respect to the first direction with an acute angle.

19. The developing cartridge according to claim 1, wherein the developing cartridge is attachable to a drum cartridge including a photosensitive drum, and wherein, in a state where the developing cartridge is attached to the drum cartridge, the developing roller is in contact with the photosensitive drum in a case where the first shaft is at the first position and the second shaft is at the third position; and wherein, in the state where the developing cartridge is attached to the drum cartridge, the developing roller is in separated from the photosensitive drum in a case where the first shaft is at the second position and the second shaft is at the fourth position.

20. The developing cartridge according to claim 19, wherein the drum cartridge includes a drum frame supporting the photosensitive drum, wherein the first inclined surface and the second inclined surface are out of contact with the drum frame in the case where the first shaft is at the first position and the second shaft is at the third position, and the first inclined surface and the second inclined surface are in contact with the drum frame in the case where the first shaft is at the second position and the second shaft is at the fourth position.

21. The developing cartridge according to claim 1, wherein the first shaft, the second shaft, and the link mechanism are positioned between the first inclined surface and the second inclined surface in the first direction.

22. A developing cartridge comprising:

a casing configured to accommodate therein developing agent;

a developing roller rotatable about a first axis extending in a first direction, the casing having one end portion and another end portion in the first direction;

a first shaft extending along a second axis extending in the first direction, the first shaft being movable along the second axis;

a first cam movable together with the first shaft along the second axis, the first cam having a first inclined surface inclined with respect to the first direction;

a second shaft extending along a third axis extending in the first direction, the second shaft being movable along the third axis;

a second cam movable together with the second shaft along the third axis, the second cam having a second inclined surface inclined with respect to the first direction; and a link mechanism connecting the first shaft to the second shaft, the link mechanism being configured to shift between a first state and a second state in accordance with movement of the first shaft along the second axis, wherein the second shaft and the second cam are movable along the third axis in accordance with shifting of the link mechanism from the first state to the second state.

23. The developing cartridge according to claim 22, wherein the first inclined surface is inclined to be distant from the first shaft in a second direction crossing the first direction as extending from the another end portion of the casing in the first direction toward the one end portion of the casing in the first direction.

24. The developing cartridge according to claim 22, wherein the second inclined surface is inclined to be distant from the second shaft in a second direction crossing the first direction as extending from the another end portion of the casing in the first direction toward the one end portion of the casing in the first direction.

25. The developing cartridge according to claim 22, wherein the first shaft has one end portion and another end portion in the first direction, the one end portion of the first shaft being positioned closer to the one end portion of the casing in the first direction than the another end portion of the first shaft is to the one end portion of the casing in the first direction, wherein the second shaft has one end portion and another end portion in the first direction, the one end portion of the second shaft being positioned closer to the one end portion of the casing in the first direction than the another end portion of the second shaft is to the one end portion of the casing in the first direction, and wherein the link mechanism comprises:

a first link having one end portion connected to the another end portion of the first shaft;

a second link having one end portion connected to the one end portion of the second shaft; and a connection bar connected to another end portion of the first link and to another end portion to the second link.

26. The developing cartridge according to claim 25, wherein the first link is pivotally movable about a first pivot axis extending in the second direction, and wherein the second link is pivotally movable about a second pivot axis extending in the second direction.

27. The developing cartridge according to claim 26, wherein the first shaft is movable along the second axis between a first position and a second position, wherein the second shaft is movable along the third axis between a third position and a fourth position, and wherein, in accordance with movement of the first shaft from the first position to the second position, the first link pivotally moves about the first pivot axis to move the connection bar in the first direction to cause pivot movement of the second link about the second pivot axis, to thus move the second shaft from the third position to the fourth position.

28. The developing cartridge according to claim 26, wherein the first direction is perpendicular to the second direction.

29. The developing cartridge according to claim 26, further comprising:

a first screw extending in the second direction and supporting the first link to the casing; and a second screw extending in the second direction and supporting the second link to the casing.

30. The developing cartridge according to claim 29, wherein the first link is pivotally movable about the first screw, and wherein the second link is pivotally movable about the second screw.

31. The developing cartridge according to claim 26, wherein the casing has an outer surface extending in a direction crossing the second direction, and wherein the first link, the second link, and the connection bar are positioned at the outer surface.

32. The developing cartridge according to claim 22, wherein the first shaft, the second shaft, and the link mechanism are positioned between the first cam and the second cam in the first direction.

* * * * *